US008438737B2

(12) United States Patent
Lo et al.

(10) Patent No.: US 8,438,737 B2
(45) Date of Patent: May 14, 2013

(54) FRUIT AND VEGETABLES SLICING APPARATUS STRUCTURE

(76) Inventors: Kuo-Hung Lo, Taipei (TW); Shu-Ping Huang, Taipei (TW)

( * ) Notice: Subject to any disclaimer, the term of this patent is extended or adjusted under 35 U.S.C. 154(b) by 309 days.

(21) Appl. No.: 12/943,026

(22) Filed: Nov. 10, 2010

(65) Prior Publication Data

US 2012/0110860 A1 May 10, 2012

(51) Int. Cl.
*B26B 1/00* (2006.01)
*B26B 3/04* (2006.01)

(52) U.S. Cl.
USPC ..... 30/114; 30/299; 30/304; 30/320; 30/321

(58) Field of Classification Search ..... D7/673; 99/537; 454/290; 30/114–117, 299–305, 30/312, 320, 321; 83/856, 858
See application file for complete search history.

(56) References Cited

U.S. PATENT DOCUMENTS

| | | | | | |
|---|---|---|---|---|---|
| 1,097,479 | A | * | 5/1914 | Starr | 83/858 |
| 1,463,941 | A | * | 8/1923 | Cusimano | 30/303 |
| 1,626,550 | A | * | 4/1927 | Miller | 83/858 |
| 1,864,147 | A | * | 6/1932 | Rantine | 30/303 |
| D92,121 | S | * | 4/1934 | Wagner | D7/673 |
| 2,023,706 | A | * | 12/1935 | Smith | 30/303 |
| D104,454 | S | * | 5/1937 | Koch | D7/673 |
| 2,114,277 | A | * | 4/1938 | Bloomfield | D7/673 |
| 2,242,607 | A | * | 5/1941 | Ehlke | 30/303 |
| D147,401 | S | * | 9/1947 | Cohen | D7/673 |
| D154,071 | S | * | 6/1949 | Smith | D7/673 |
| 2,661,535 | A | * | 12/1953 | Berles | 30/305 |
| 2,792,865 | A | * | 5/1957 | Sunskes | 83/642 |
| 3,727,307 | A | * | 4/1973 | Berger | 30/304 |
| D246,411 | S | * | 11/1977 | Blanchard | D7/673 |
| 4,055,892 | A | * | 11/1977 | Del Vecchio | 30/303 |
| 4,096,629 | A | * | 6/1978 | Levine | 30/304 |
| 4,222,510 | A | * | 9/1980 | Kouloumbini et al. | 99/537 |
| 4,553,325 | A | * | 11/1985 | Allahverdian | 30/114 |
| 4,592,139 | A | * | 6/1986 | Huang | 30/114 |
| 4,606,125 | A | * | 8/1986 | Jensen | 30/302 |
| 4,807,362 | A | * | 2/1989 | Prentice | 30/303 |
| 4,998,348 | A | * | 3/1991 | Foate | 30/305 |
| 5,035,056 | A | * | 7/1991 | Sheffield | 30/305 |
| 5,074,777 | A | * | 12/1991 | Garner | 30/303 |
| D409,054 | S | * | 5/1999 | Wirfel | D7/673 |
| 5,966,819 | A | * | 10/1999 | Coleman | 30/301 |
| D416,177 | S | * | 11/1999 | Hood | D7/673 |
| 6,033,304 | A | * | 3/2000 | Haynes | 454/290 |
| 6,322,442 | B1 | * | 11/2001 | Cordell | 454/290 |
| 6,537,146 | B1 | * | 3/2003 | Haynes | 454/290 |
| D475,584 | S | * | 6/2003 | Bachman et al. | D7/673 |
| 6,796,032 | B2 | * | 9/2004 | Horng | 30/114 |
| 6,863,203 | B2 | * | 3/2005 | Cismoski | 30/299 |
| 7,266,894 | B1 | * | 9/2007 | Hinckley | 30/305 |
| 7,658,010 | B2 | * | 2/2010 | So et al. | 30/114 |
| 2004/0250667 | A1 | * | 12/2004 | Atwater | 30/303 |
| 2006/0185488 | A1 | * | 8/2006 | Short et al. | 83/858 |

(Continued)

OTHER PUBLICATIONS

Slap Chop™, https://slapchop.com/, 2010.*

*Primary Examiner* — Jason Daniel Prone

(57) ABSTRACT

A handheld fruit and vegetables slicing apparatus having a plurality of linked together rotatable knives connected to a frame. One of the knives being attached to a rotatable adjustment element on the frame, such that when the adjustment element is rotated the plurality of knives rotate from an original upright state to a flat state for rinsing.

7 Claims, 12 Drawing Sheets

U.S. PATENT DOCUMENTS

2006/0272162 A1* 12/2006 Atwater et al. ..... 30/303
2006/0272461 A1* 12/2006 Atwater et al. ..... 30/303
2007/0294898 A1* 12/2007 Beltran ..... 30/307
2008/0229938 A1* 9/2008 Hutto ..... 99/537
2010/0011973 A1* 1/2010 Kovacs ..... 99/537
2011/0296695 A1* 12/2011 Temiz ..... 30/302
2012/0017731 A1* 1/2012 Mastroianni et al. ..... 99/537
2012/0137900 A1* 6/2012 Tateno ..... 30/299

* cited by examiner

-Prior Art-

FRUIT AND VEGETABLES SLICING APPARATUS STRUCTURE

BACKGROUND OF THE INVENTION

1. Technical Field

The present invention relates to fruit and vegetables slicing apparatuses, and more particularly, to a slicing apparatus having a rotatable knife angle.

2. Description of Related Art

According to the prior art, to cut fruit and vegetables into strips, a person has to hold the fruit and vegetables by his or her hand and produce the strips one by one with a knife. The prior art has drawbacks, namely a time-consuming cutting process and inconsistent thickness of strips. Hence, there are commercially available knives dedicated to cutting fruit and vegetables. Referring to FIG. 1, a slicing apparatus 1 comprises a base 11, a plurality of blades 12 disposed in the base 11, and handles 13 extending outward from two sides of the base 11, respectively. To cut fruit and vegetables, a user places the fruit and vegetables beneath the base 11, grips the handles 13 by hands, and presses the base 11 to enable the blades 12 to cut the fruit and vegetables, thereby allowing the fruit and vegetables to be cut into a plurality of strips by the blades 12. Hence, fruit and vegetables are cut into a plurality of strips, using the slicing apparatus 1. With the blades 12 being equidistantly spaced apart from each other, the strips thus obtained are of the same thickness. The blades 12 are disposed in the base 11 and fixed thereto, and thus the blades 12 are not removable from the base 11. The space between adjacent ones of the blades 12 is small. After the process of cutting fruit and vegetables has finished, residues or other foreign bodies are likely to remain on the blades 12. As a result, it is necessary to insert another tool into the space between the blades 12 in order to remove the residues therefrom. Doing so, however, is not user-friendly.

BRIEF SUMMARY OF THE INVENTION

Considering the aforesaid drawbacks of the prior art, the inventor of the present invention proposes a slicing apparatus structure having a rotatable knife angle to achieve the following objective.

The primary objective of the present invention is to provide fruit and vegetables slicing apparatus structure comprising: a frame; a plurality of knives disposed in the frame; a linking mechanism for connecting the plurality of knives concurrently; and an adjusting element disposed on one side of the frame and configured to enable the linking mechanism to drive the knives to rotate concurrently by an angle upon completion of a cutting process performed by the knives, such that each of the knives switches from an original upright state to a flat state to thereby achieve the goal of the easy rinsing of the knives.

DETAILED DESCRIPTION OF THE INVENTION

Figure 1:
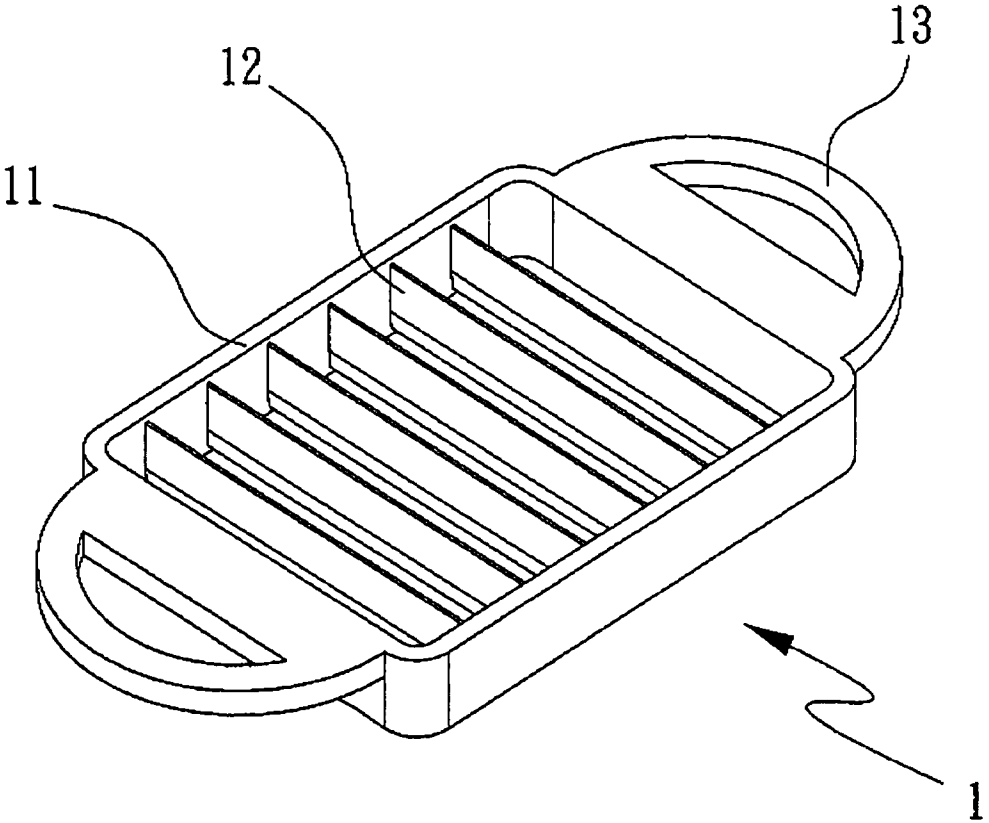
FIG. 1 is a perspective view of the prior art.
Figure 2:
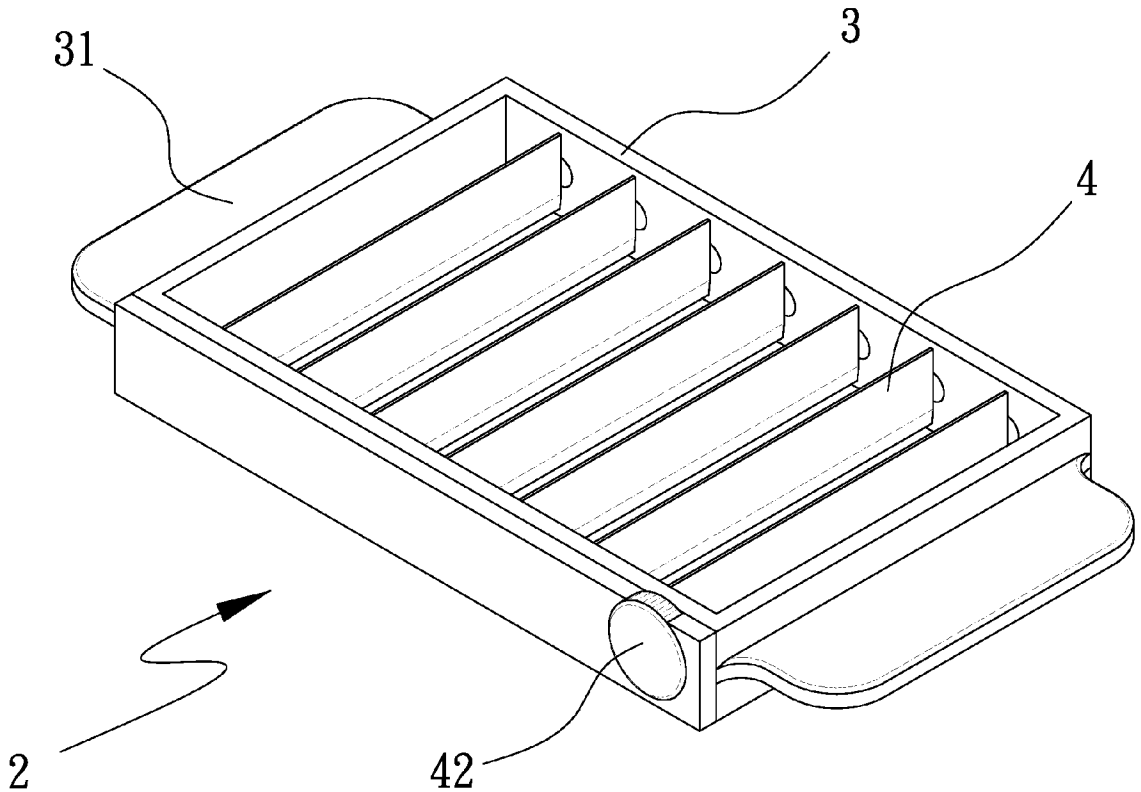
FIG. 2 is a perspective view of the present invention.
Figure 3:
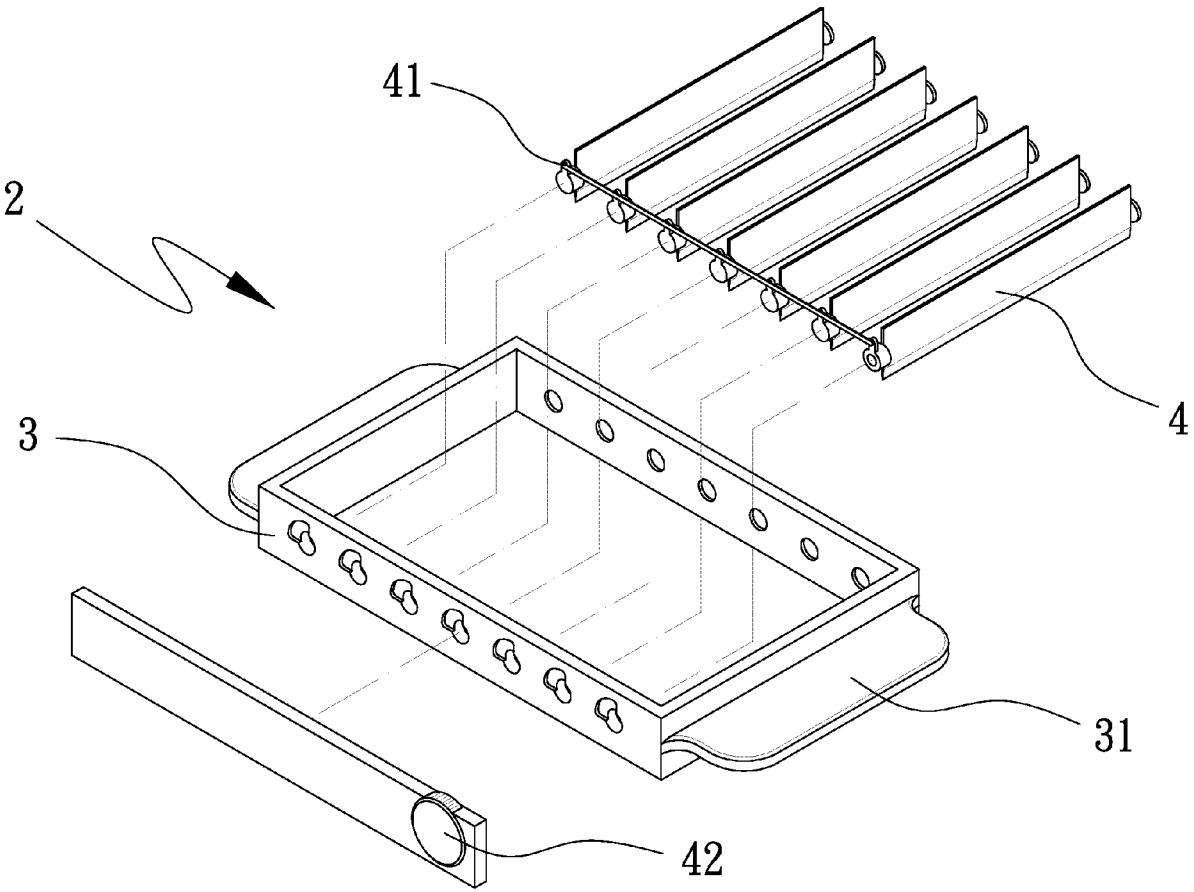
FIG. 3 is an exploded perspective view of the present invention.
Figure 4:
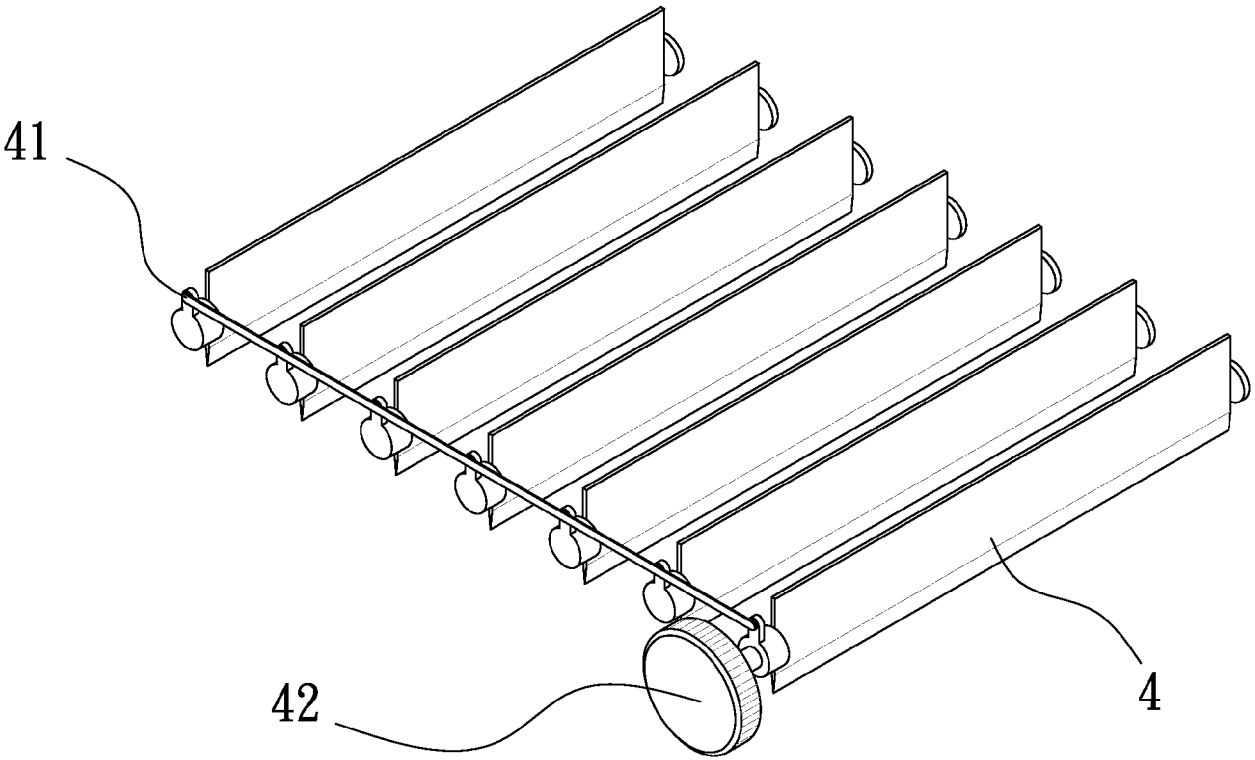
FIG. 4 is a partial schematic view of the present invention.
Figure 5:
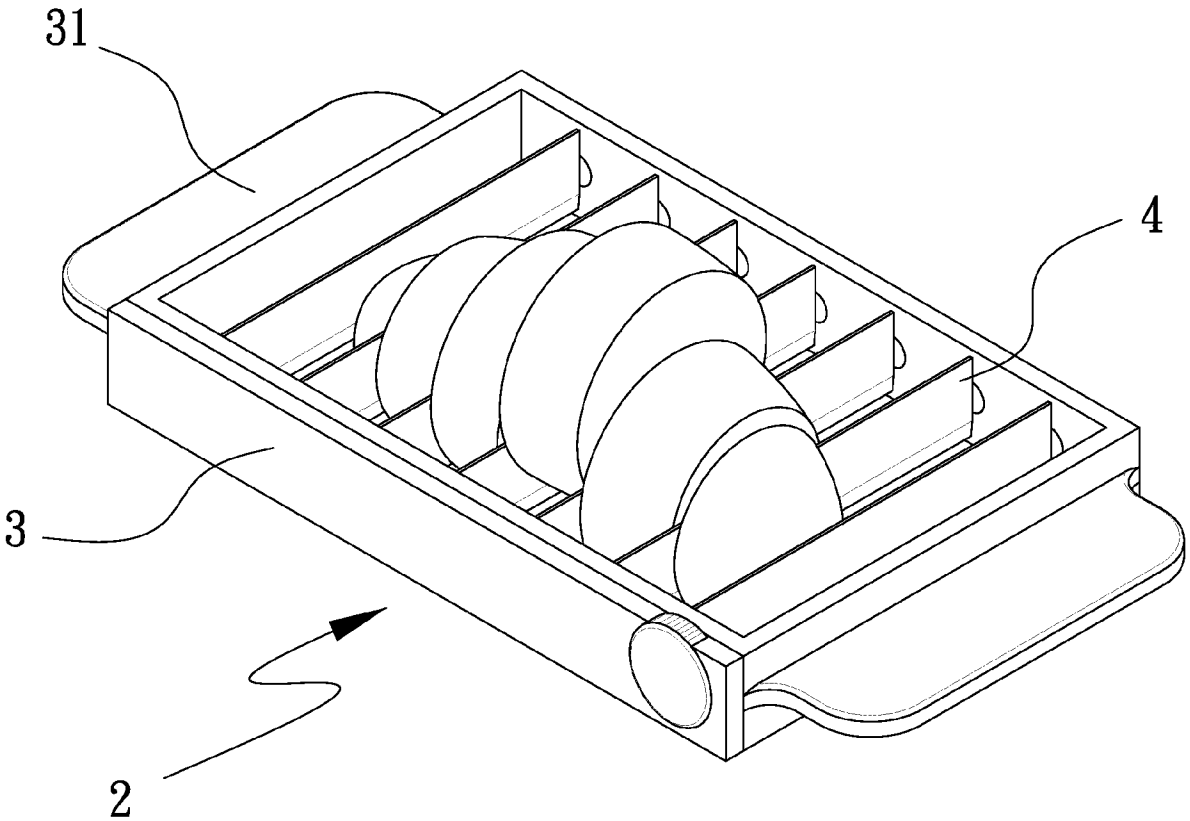
FIG. 5 is the first diagram of a preferred embodiment of the present invention.
Figure 6:
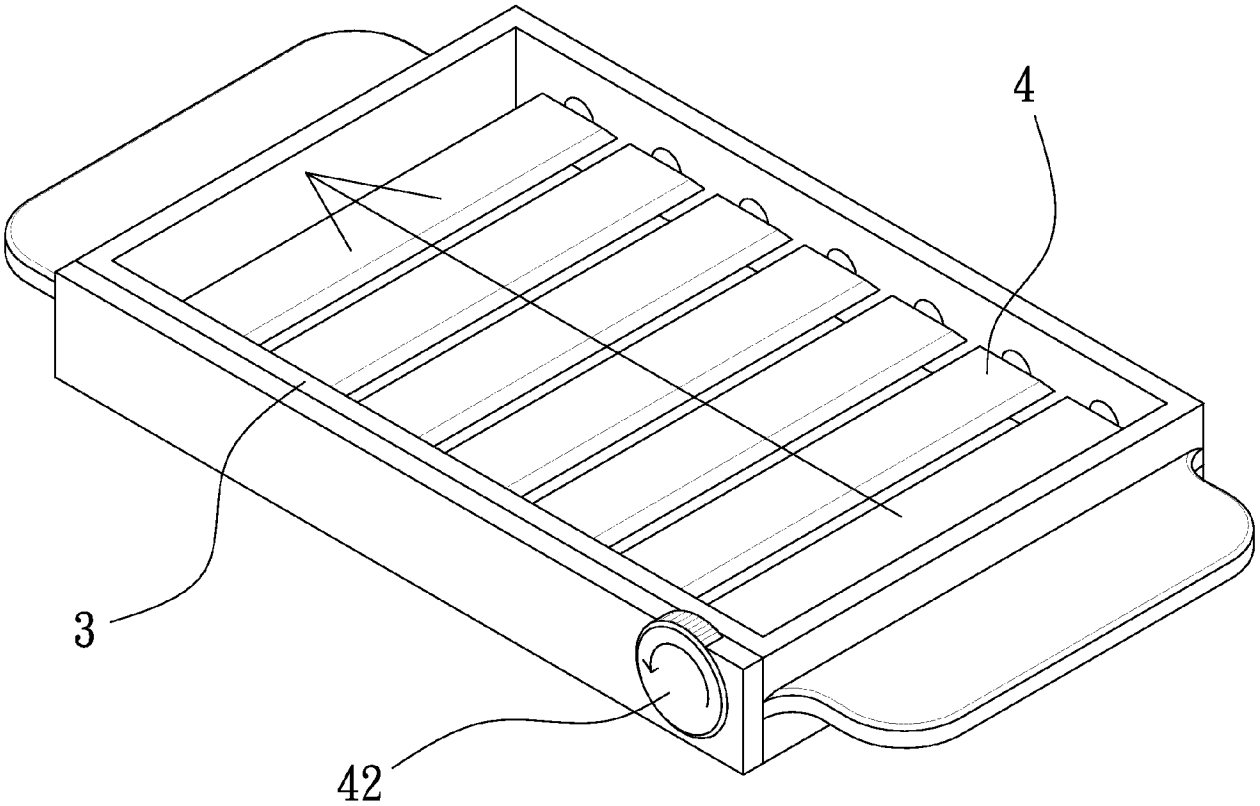
FIG. 6 is the second diagram of the preferred embodiment of the present invention.
Figure 7:
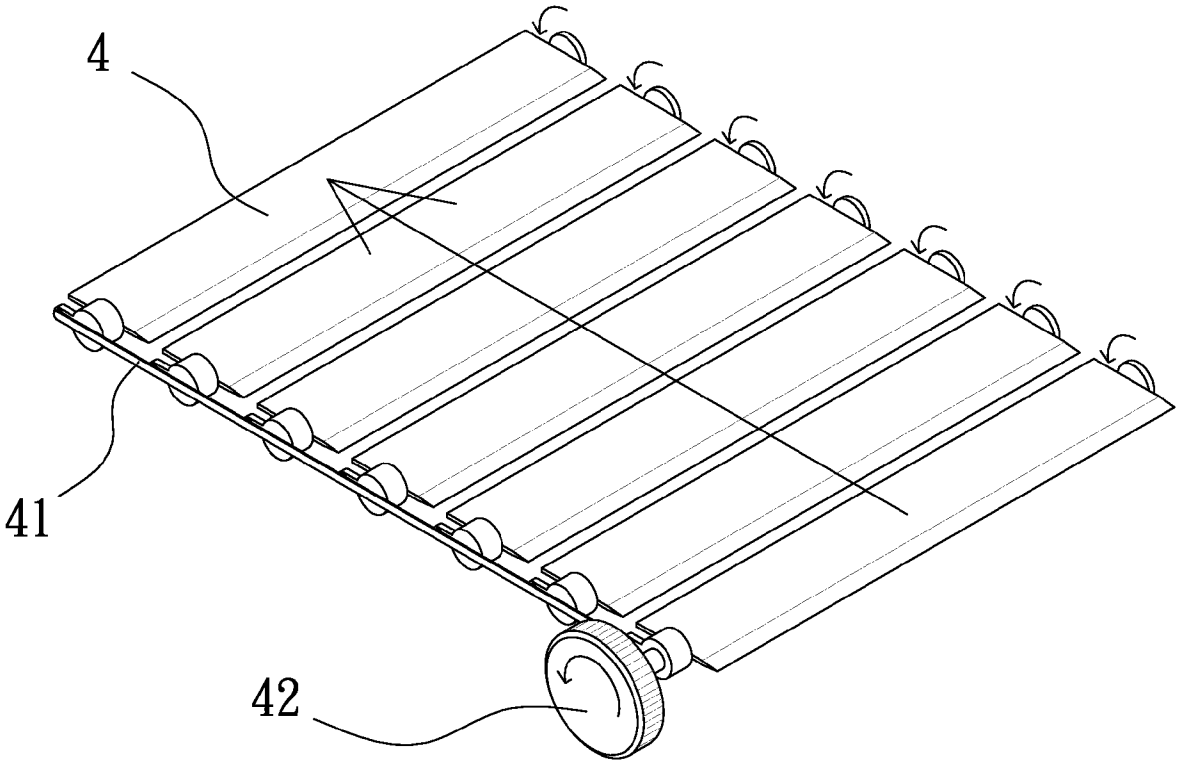
FIG. 7 is the third diagram of the preferred embodiment of the present invention.

In order to achieve the above and other objectives and benefits, the present invention is hereunder illustrated with preferred embodiments described in conjunction with the accompanying drawings with a view to enabling persons skilled in the art to implement the various objectives of the present invention.

First, referring to FIG. 2, FIG. 3, FIG. 4, FIG. 5, FIG. 6 and FIG. 7, there are shown a perspective view, an exploded perspective view, a partial schematic view, and diagrams of a preferred embodiment of the present invention, respectively. As shown in the drawings, a slicing apparatus 2 comprises:

a frame 3 externally provided with at least one gripping portion 31;

a plurality of knives 4 disposed in the frame 3 and equidistantly spaced apart from each other;

a linking mechanism 41 disposed on one side of the knives 4 and configured to connect the plurality of knives 4; and an adjusting element 42 disposed on one side of the frame 3 and connected to one of the knives 4.

The at least one gripping portion 31 outwardly extended from the frame 3 is gripped by a user's hands. Fruit and vegetables to be sliced are position beneath a plurality of the knives 4. The user's hands exert a downward force on the frame 3 to enable the plurality of the knives 4 to cut the fruit and vegetables into a plurality of strips. After the fruit and vegetables have been cut, residues or juice of fruit and vegetables remain on the surfaces of the knives 4. The adjusting element 42 disposed on one side of the frame 3 can be tuned, so as to drive the plurality of the knives 4 to rotate accordingly and switch from an original upright state to a flat state, such that the surfaces of the knives 4 face outward. In so doing, the knives 4 can be rinsed to remove residues or juice therefrom easily. Tuning the adjusting element 42 actually causes the knife 4 connected thereto to rotate. Since each of the knives 4 is connected to the linking mechanism 41, rotation of the knife 4 connected to the adjusting element 42 drives all the other ones of the knives 4 to rotate, and in consequence all the knives 4 switch from the original upright state to the flat state.

The problem solved by the present invention is described below. Blades disposed in a conventional fruit and vegetables slicing apparatus are fixed to a base and thus neither movable nor removable. Upon completion of the use of the slicing apparatus, it is difficult to rinse the blades. Hence, the present invention provides a fruit and vegetables slicing apparatus structure comprising the linking mechanism 41 and the adjusting element 42 whereby, after finishing the use of the slicing apparatus 2, the user rotates the knives 4 to allow the knives 4 to enter a flat state, such that the user can rinse the surfaces of the knives 4 easily. In addition to the ease of rinsing, the present invention serves the purpose of user safety. The fruit and vegetables slicing apparatus structure of the present invention is safe to use, because the knives 4 are rotatable. Hence, the knives 4 can be rotated to enter a flat state when the slicing apparatus 2 is idle, such that the cutting ends of the knives 4 are no longer facing outward.

Referring to FIG. 8, FIG. 9, FIG. 10, FIG. 11 and FIG. 12, there are shown diagrams of a further preferred embodiment of the present invention, respectively. As shown in the drawings, a slicing apparatus 5 comprises:

a base 6;

a gripping portion 61 disposed on one side of the base 6;

a plurality of knives 7 disposed on one side of the base 6;

a linking mechanism 71 disposed on one side of the plurality of knives 7 and configured to connect the plurality of knives 7; and an adjusting element 72 disposed on one side of the base 6 and connected to one of the plurality of knives 7.

The user grips the gripping portion 61 disposed on one side of the base 6, puts fruit and vegetables beneath the plurality of knives 7, presses the base 6 to enable the plurality of knives 7 to cut the fruit and vegetables into a plurality of strips. Upon completion of the process of cutting the fruit and vegetables, residues or juice of the fruit and vegetables remain on the surfaces of the plurality of knives 7. The adjusting element 72 disposed on one side of the base 6 is tuned, so as to rotate the plurality of knives 7, thereby allowing the plurality of knives 7 to switch from an original upright state to a flat state; as a result, the surfaces of the plurality of knives 7 face outward. In so doing, the plurality of knives 7 can be rinsed to remove residues or juice therefrom easily.

Figure 8:
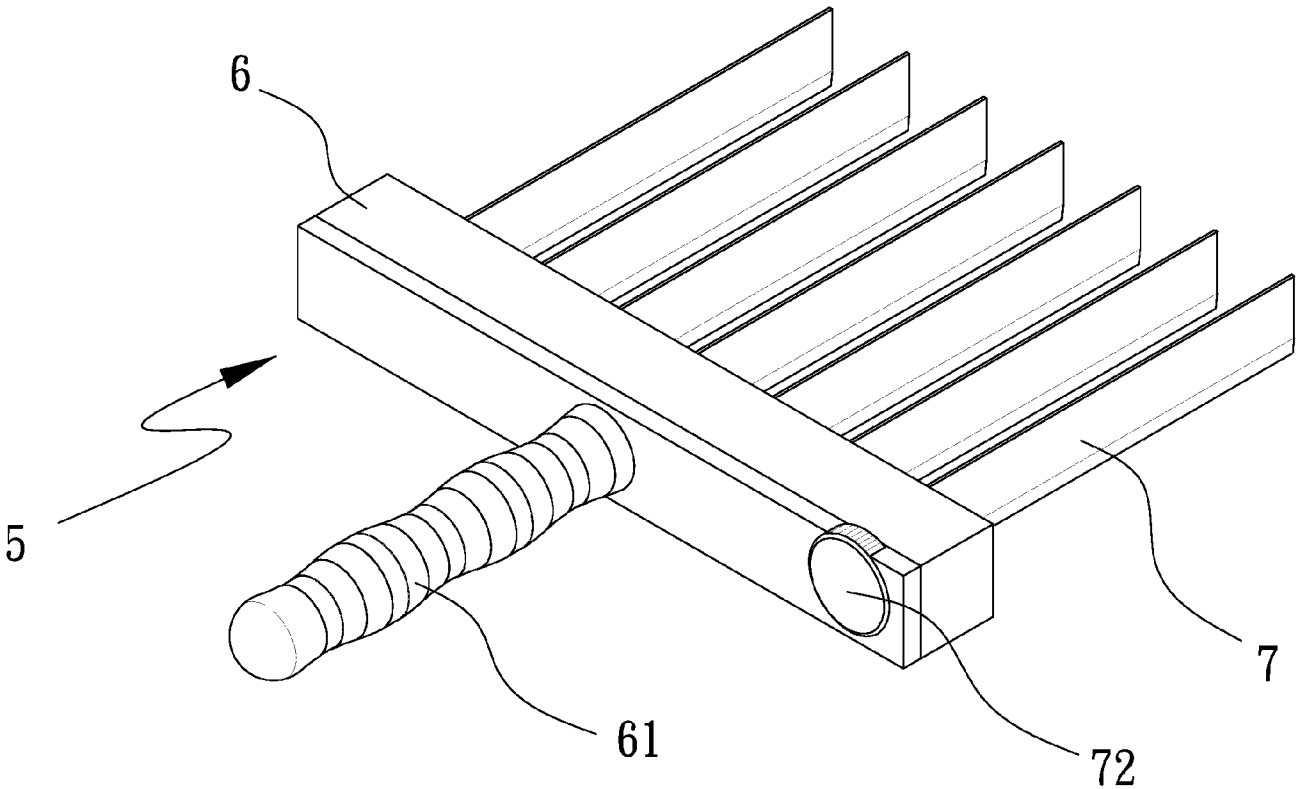
FIG. 8 is the first diagram of a further preferred embodiment of the present invention.
Figure 9:
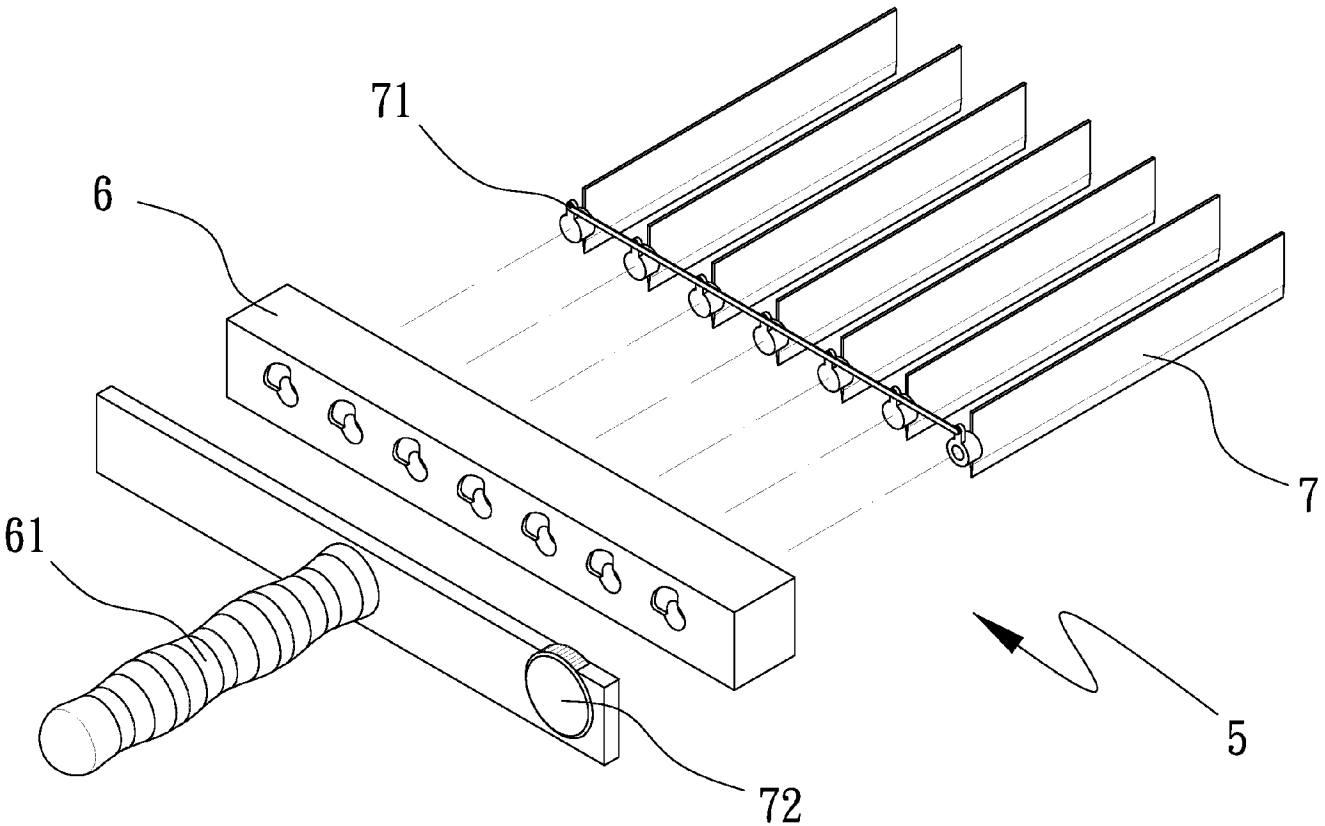
FIG. 9 is the second diagram of the further preferred embodiment of the present invention.
Figure 10:
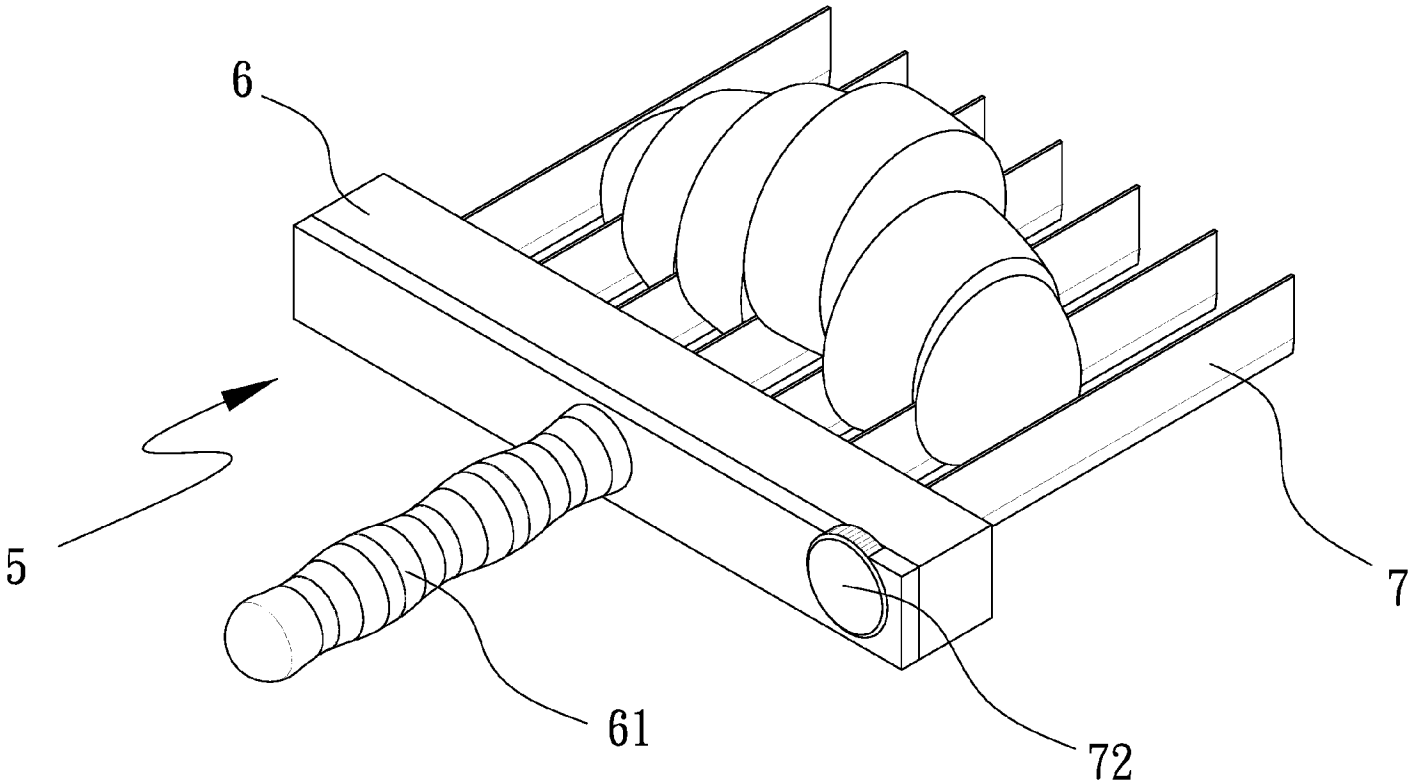
FIG. 10 is the third diagram of the further preferred embodiment of the present invention.
Figure 11:
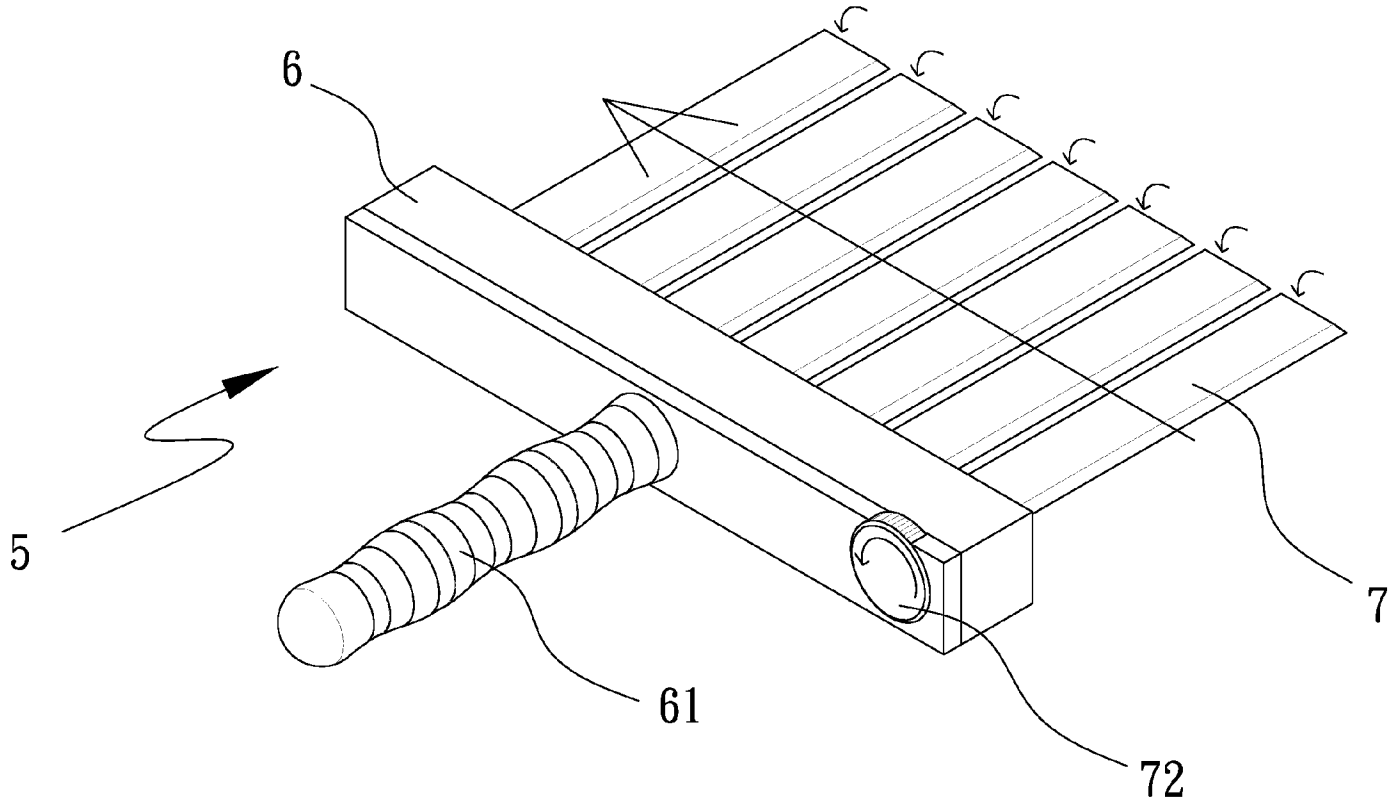
FIG. 11 is the fourth diagram of the further preferred embodiment of the present invention.
Figure 12:
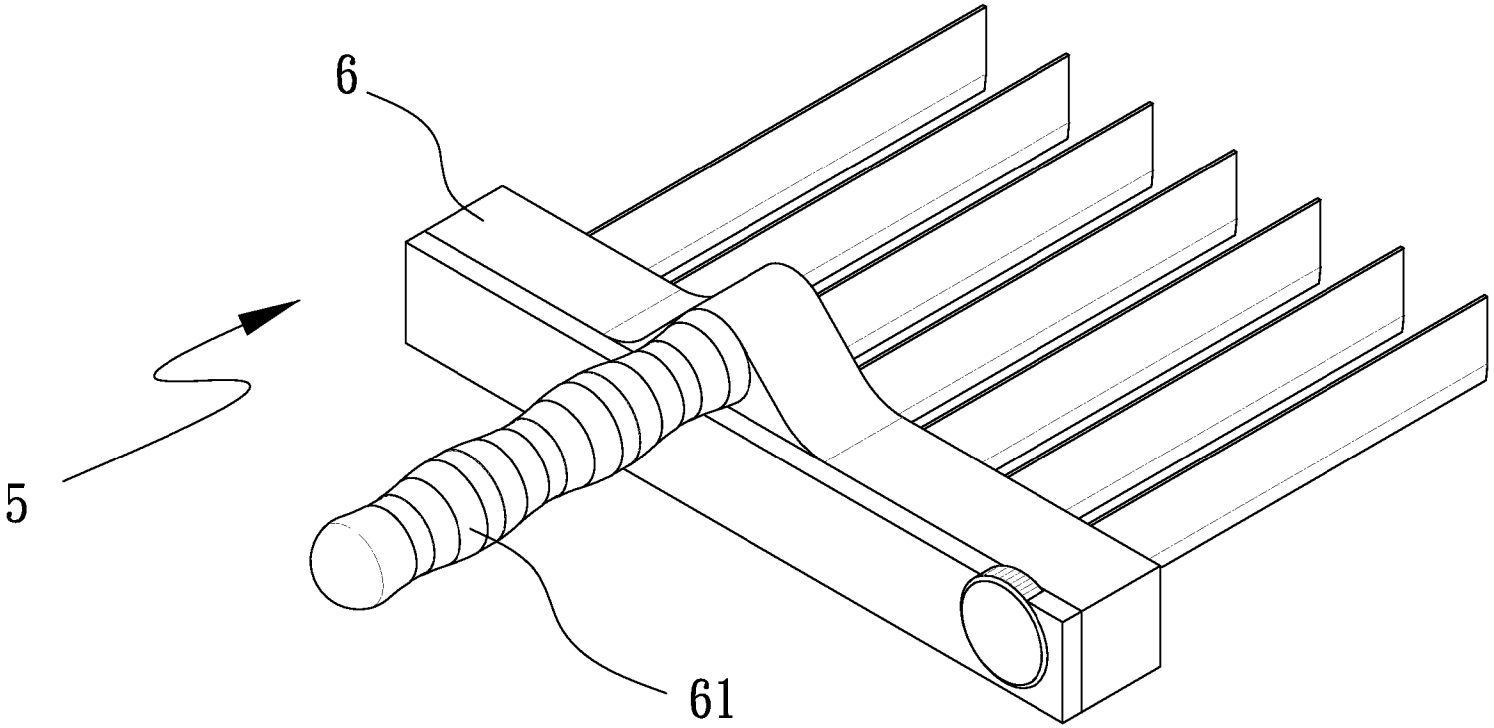
FIG. 12 is the fifth diagram of the further preferred embodiment of the present invention.

In this embodiment, the gripping portion 61 is disposed at a different position (as shown in FIGS. 8 and 12) to provide a different way of applying a force. Another essential feature of this embodiment is that the plurality of knives 7 are exposed to the outside; as a result, not only is it feasible to press the plurality of knives 7 in order to cut fruit and vegetables into a plurality of strips, but the plurality of knives 7 can be operated in a conventional way such that the user grips the gripping portion 61 and controls the cutting process of the plurality of knives 7 at different angles.

What is claimed is:

1. A handheld fruit and vegetables slicing apparatus structure comprising:

a frame;

a plurality of knives pivotally disposed in the frame;

a linking mechanism disposed on a side of the plurality of knives and configured to connect the plurality of knives; and an adjustment element rotatably disposed on a side of the frame and connected to one of the knives;

wherein the plurality of knives cut fruit and vegetables into a plurality of strips, and the adjusting element disposed on the side of the frame rotates the one of the knives which in turns moves the linking mechanism which rotates the remaining knives concurrently by an angle upon completion of a cutting process performed by the knives, thereby allowing each of the knives to switch from an original upright state to a flat state to thereby enable easy rinsing of the knives.

2. The handheld fruit and vegetables slicing apparatus structure of claim 1, wherein the frame is externally provided with at least one gripping portion.

3. The handheld fruit and vegetables slicing apparatus structure of claim 1, wherein the plurality of knives are equidistantly spaced apart from each other.

4. A fruit and vegetables a slicing apparatus structure, comprising:

a base;

a gripping portion disposed on a side of the base;

a plurality of knives pivotally disposed on a side of the base;

a linking mechanism disposed on a side of the plurality of knives and configured to connect the plurality of knives; and an adjustment element rotatably disposed on a side of the base and connected to one of the plurality of knives;

wherein a user grips the gripping portion, controllably presses the base to enable the plurality of knives to cut fruit and vegetables into a plurality of strips, and, upon completion of the cutting of the fruit and vegetables, turns the adjusting element disposed on the side of the base to enable the linking mechanism to drive the plurality of knives to rotate by an angle concurrently, thereby allowing each of the plurality of knives to switch from an original upright state to a flat state to thereby enable easy rinsing of the knives.

5. The fruit and vegetables slicing apparatus structure of claim 4, wherein the plurality of knives are equidistantly spaced apart from each other.

6. The fruit and vegetables slicing apparatus structure of claim 4, wherein the side of the base where the gripping portion is disposed is an end side.

7. The fruit and vegetables slicing apparatus structure of claim 4, wherein the side of the base where the gripping portion is disposed is an upper side.

* * * * *